United States Patent [19]

Hilding et al.

[11] 3,965,997

[45] June 29, 1976

[54] METHOD AND APPARATUS FOR GUIDING AND SEALING A DRILL STRING

[75] Inventors: Jonas Olof Anders Hilding; Jan Edvard Persson, both of Nacka, Sweden

[73] Assignee: Atlas Copco Aktiebolag, Nacka, Sweden

[22] Filed: Dec. 16, 1974

[21] Appl. No.: 533,131

[30] Foreign Application Priority Data

Dec. 21, 1973 Sweden ..... 7317341

[52] U.S. Cl. ..... 175/65; 173/35; 173/43; 173/52; 175/209

[51] Int. Cl.[2] ..... E21B 19/14; E21B 19/16; E21C 9/00

[58] Field of Search ..... 175/209, 210, 65; 173/35, 43, 52

[56] References Cited

UNITED STATES PATENTS

| | | | |
|---|---|---|---|
| 2,041,689 | 5/1936 | Baumeister et al. | 175/209 X |
| 2,730,333 | 1/1956 | Lenhart, Jr. et al. | 175/209 X |
| 2,734,724 | 2/1956 | Larcen | 173/43 |
| 2,781,185 | 2/1957 | Robbins | 175/209 X |
| 2,849,212 | 8/1958 | Robbins | 175/209 X |
| 3,498,674 | 3/1970 | Matthews | 175/209 X |

*Primary Examiner*—Stephen J. Novosad
*Attorney, Agent, or Firm*—Flynn & Frishauf

[57] ABSTRACT

A method and apparatus for guiding and sealing a drill string during drilling. The drill string is formed with an increased diameter at the portions where two adjacent rods are connected. The guiding and sealing of the rods is maintained by means of hydraulically operated guide jaws in a drill rod centralizer. The increased diameter portions are guided and sealed by means of tubular members located rearwardly and forwardly of said jaws. The drill rod centralizer is mounted on a saddle which is slidable along a feed bar. The drill rod centralizer is connected to means for removing drill dust and may be provided with a tubular portion for guiding the drill bit during collaring of a new hole.

10 Claims, 7 Drawing Figures

14
15
24
26
25
27
12
26
23
22
13
290
20
11
10
16
21
17
18
19

METHOD AND APPARATUS FOR GUIDING AND SEALING A DRILL STRING

This invention relates to a method of rock drilling wherein a string of connected drill rods is moved through a drill rod centralizer while drill dust is removed therefrom by suction. The string is formed with an increased diameter at the portions where two adjacent rods are connected. The present invention also provides for an improved apparatus for guiding and sealing a drill string during drilling.

In U.S. Pat. No. 2,734,724, assigned to the same assignee as the present application a drill rig is shown which is intended to be used during tunnelling and mining. A drill rod centralizer is mounted on a feed bar at the front end thereof and is displaced during drilling by means of a pneumatic cylinder toward the rock surface to rest thereagainst or against a stop mounted on the feed bar, if the stop is reached first.

An object of the present invention is to achieve an effective guiding and sealing of the drill string and an effective removal of drill dust during drilling. Another object is to achieve an effective guiding of the drill bit during the collaring of a new hole in order to make it possible to carry out the collaring with full efficiency independently of the nature of the ground. This requires that the drill rod centralizer, which is provided with means for removal of drill dust, has to rest all the time against the ground and further, has to be sealed effectively relative to the drill string at its rear portion. A further object of the invention is to make possible an exchange of drill bits without changing the position of the feed bar with respect to the ground.

SUMMARY OF THE INVENTION

According to one aspect of the invention there is provided in a method of rock drilling by means of a string of connected drill rods, said string being formed with an increased diameter at the portions where two adjacent rods are connected, comprising moving the string through a drill rod centralizer while drill dust is removed therefrom by suction, the improvement comprising guiding and gapsealing of the drill string constantly during the drilling at guide surfaces in the drill rod centralizer located rearwardly of the place of suction.

According to another aspect of the invention there is provided an apparatus for guiding and sealing a string of connected drill rods during drilling, comprising an elongated support for a rock drill movable therealong, a string of connected drill rods, said string being connectable at one end thereof to said rock drill to be driven longitudinally with respect to said support, said string having an increased diameter at the portions where two adjacent rods are connected, a drill rod centralizer mounted on said support, dust removing means connected to said drill rod centralizer for removing drill dust therefrom by suction, at least two guide jaws in said drill rod centralizer located rearwardly of said dust removing means and arranged movably towards and away fron each other, said guide jaws providing a cylindrical inner surface for guiding and sealing a drill rod when in a position moved towards each other, a first cylindrical inner surface in said drill rod centralizer located rearwardly of said guide jaws, and a second cylindrical inner surface in said drill rod centralizer and which is located between said guide jaws and said dust removing means, said first and second cylindrical inner surfaces providing the guiding and sealing of said connection portions of the string.

According to a further aspect of the invention there is provided in a drill rig, in combination: an elongated support, a rock drill mounted on said support for longitudinal movement therealong, a string of connected drill rods, said string being connectable at one end thereof to said rock drill to be driven longitudinally with respect to said support, a drill bit mounted on the other end of said string, a drill rod centralizer mounted axially displaceably on said support, and means for fixedly holding said support with respect to the ground during drilling, the improvement comprising guiding means for said drill bit in the front portion of said drill rod centralizer, said guiding means having a substantial axial extent, and said drill rod centralizer having an axial extent forwardly of said support for resting against the ground when in a projected position relative to said support.

These and other purposes of the invention will become obvious from the following description and from the accompanying drawings in which two embodiments of the invention are shown by way of example. It is to be understood that these embodiments are only illustrative of the invention and that various modifications thereof may be made within the scope of the claims following hereinafter.

DETAILED DESCRIPTION

Figure 1:
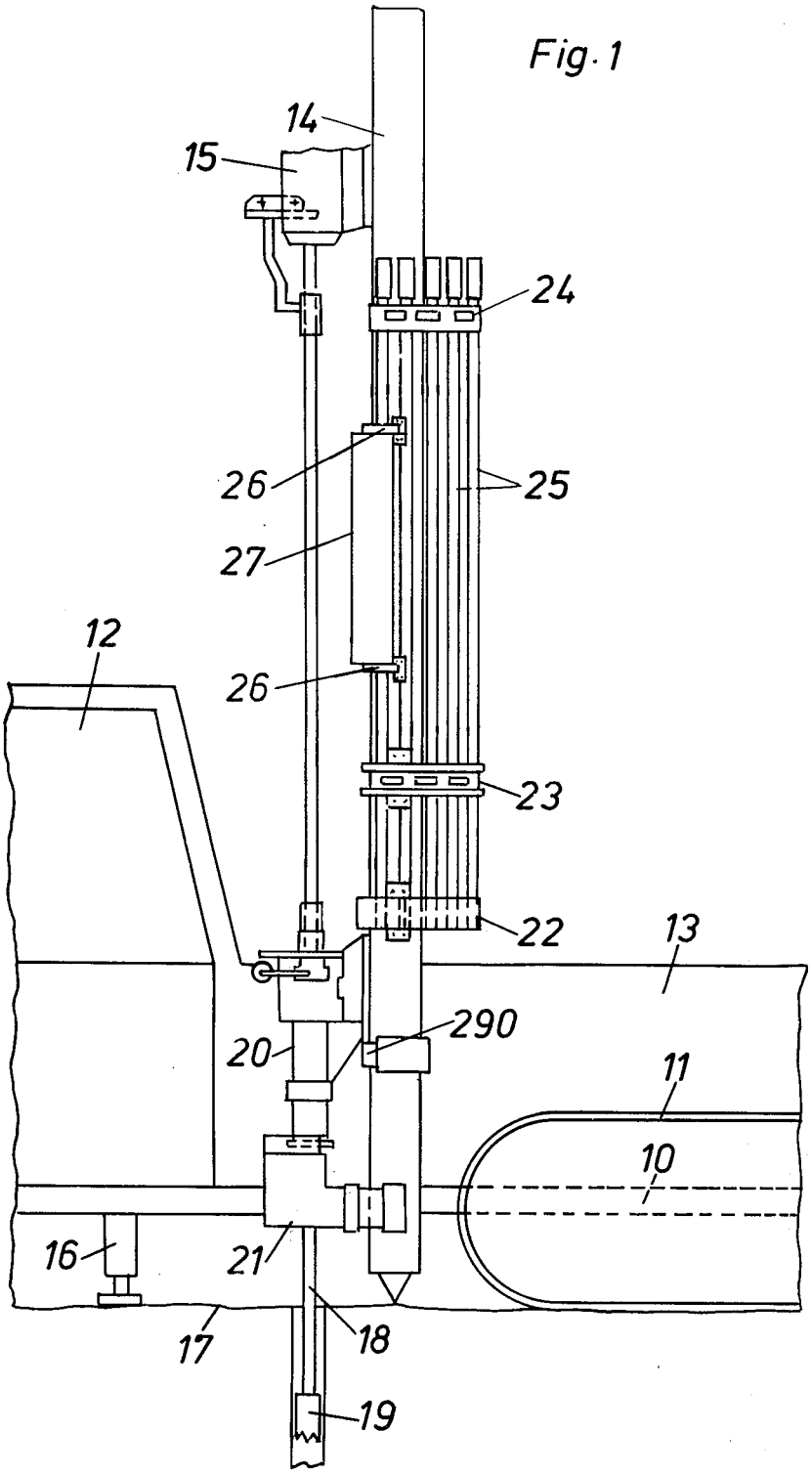
FIG. 1 shows diagrammatically a side view of a crawler mounted drill rig having a drill rod centralizer according to the present invention.

In FIG. 1, a drill rig is diagrammatically shown, having a chassis 10, crawlers 11, an operator's cab 12, a machinery housing 13 accomodating a Diesel engine, hydraulic pumps and a compressor unit, and a feed bar 14. A rock drilling machine 15, preferably hydraulic, is in known manner movable along the feed bar 14. During drilling, the chassis 10 is raised from the ground 17 by means of hydraulic levelling jacks 16. A magazine for drill rods 25 comprising three axially spaced members 22, 23 and 24 is mounted beside the feed bar 14. The drill rods are moved one by one between the magazine and the drill axis by means of a swingable transferring arm 26 with a spinning device 27 for gripping and rotating the rods mounted on the outer end of the arm 26. At the front end of the feed bar 14 there is a drill rod centralizer 20 for a string 18 of connected extension rods. The drill rod centralizer 20 is mounted on a saddle, which is freely slidable along the feed bar. In FIG. 1, the drill rod centralizer is shown in a rear position, where it can be locked by means of hydraulically operated lugs 290. At either side of the feed bar, there is a drill bit exchanging device 21 swingably journalled in such a way that it can be swung to the drill axis, when the drill rod centralizer 20 is in the shown rear position and the drill bit 19 is drawn up thereinto. A detailed description of the magazine, the transferring arm 26 with the spinning device 27 and the bit exchanging device 21 is not necessary in order to understand the present invention and has for that reason been omitted. The above members are disclosed in detail in Swedish Pat. No. 7317338-7, corresponding to U.S. Pat. application Ser. No. 533,134, filed Dec. 16, 1974 and assigned to the same assignee as the present application.

Figure 3:
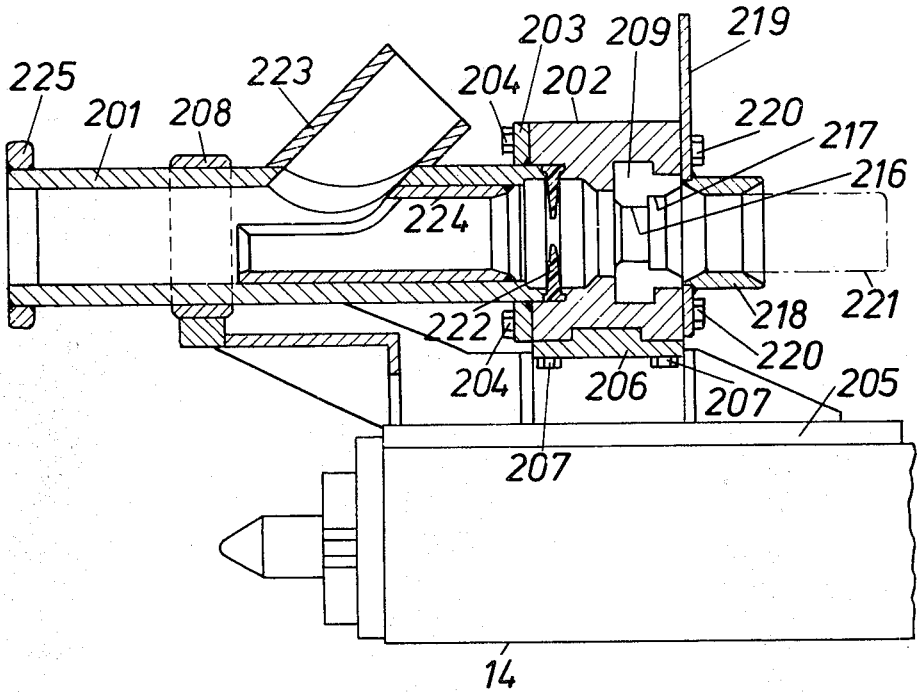
FIG. 3 is a longitudinal section through the drill rod centralizer, taken on the line III—III in FIG. 2.

As evident from the longitudinal section through the drill rod centralizer 20 shown in FIG. 3, the latter substantially comprises two members, a tubular member 201 and a prism shaped member 202. A flange 203 is welded to the upper portion of the tube 201. The flange 203 is connected to the member 202 by means of screws 204. The drill rod centralizer is mounted on a saddle 205, which is slidable along the feed bar 14. A plate 206 is welded to the upper portion of the saddle. The member 202 is attached to the plate 206 by means of screws 207. The tubular member 201 is attached to the lower portion of the saddle 205 by means of a clamp 208. A flange 225 is attached to the lower-most portion of the tube 201. Two co-operating hydraulically controlled jaws 209 and 210 are slidably mounted in the prism shaped member 202. The jaw 209 is movable (FIG. 2) by means of an arm 212, a second arm 213 pivotally connected to said arm, which second arm is swingable about a shaft 214 by means of a piston rod 215 of a cylinder, which piston rod is pivotally connected to the opposite end of the arm 213. In a position when brought together, the jaws 209 and 210 provide between themselves a first cylindrical portion 216, the diameter of which is a little larger than that of the drill rod. A second cylindrical portion 217 has a diameter which is a little smaller than the outer diameter of a coupling sleeve 221 which connects two drill rods to each other. A plate 219 is fastened to the upper side of the member 202 by means of screws 220. A cylindrical sleeve 218 is welded to the plate 219. The sleeve 218 has an inner diameter which is slightly larger than the outer diameter of the coupling sleeve 221, so that a small annular gap is provided between the sleeve 218 and the coupling sleeve 221. A seal ring 222, preferably of a plastic material is inserted at the upper portion of the tube 201 between said portion and the member 202. A second tube 223 is welded to the envelope surface of the tube 201 at about the middle thereof. Inside the tube 201 between the upper portion thereof and the tube 223 there is a sleeve 224 firmly attached to the tube 201. The inner diameter of the sleeve 224 is the same as that of the sleeve 218. The tube 201 is intended to guide the drill bit at the collaring of a new hole, for which reason the inner diameter of the tube substantially corresponds to the outer diameter of the drill bit.

Figure 5:
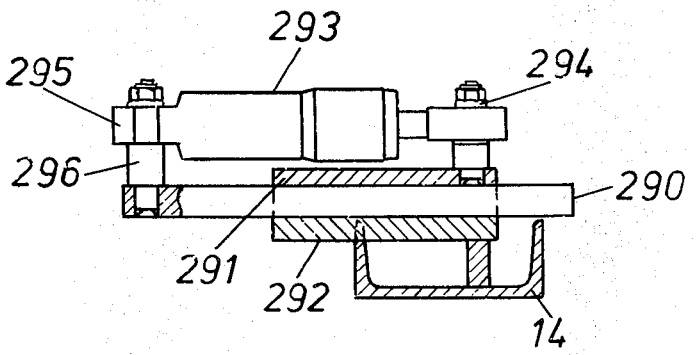
FIG. 5 is a section through the stop lug, taken on the line V—V in FIG. 4.
Figure 4:
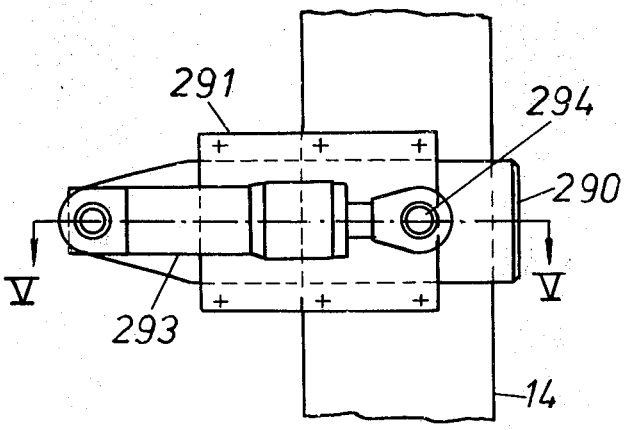
FIG. 4 shows a side view of a stop lug for the drill rod centralizer mounted on the feed bar.

On both sides of the feed bar 14 (FIGS. 4 and 5) there is a stop lug 290 for the saddle 205 of the drill rod centralizer. The stop lug 290 is guided between two parallel plates 291, 292 fastened with screws to each other. The plate 292 is attached to the feed bar 14. The piston rod of a cylinder 293 is pivotally connected to the plate 291 by means of a shaft 294. The rear part 295 of the cylinder is pivotally connected to the stop lug 290 by means of a shaft 296. In the projecting position as shown in FIGS. 4 and 5, the stop lug is intended to co-operate with a lower portion of the saddle 205 of the drill rod centralizer, thereby locking the saddle against a forward displacement.

Figure 2:
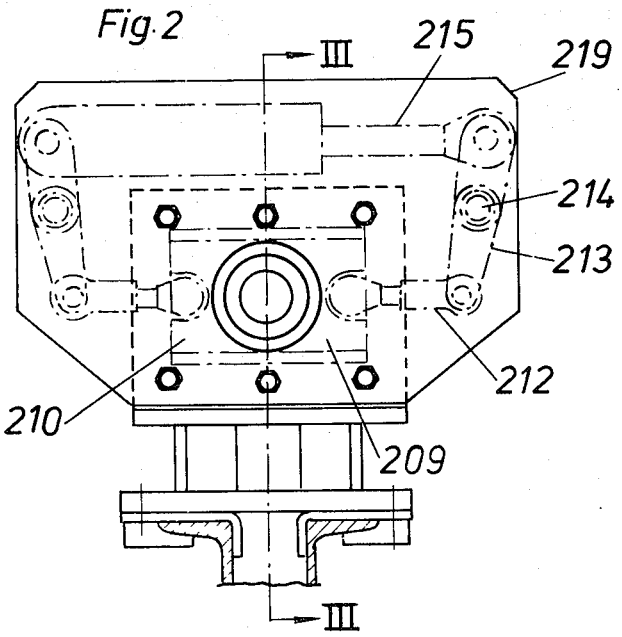
FIG. 2 shows a top view of the drill rod centralizer.
Figure 6:
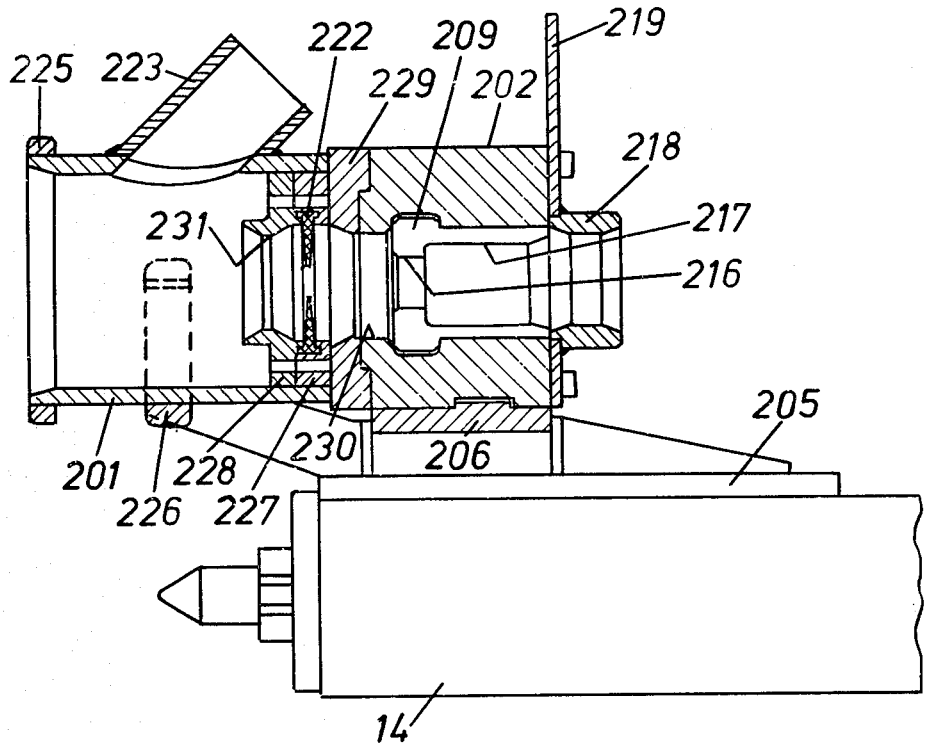
FIG. 6 is a longitudinal section through another embodiment of a drill rod centralizer, taken on the line VI—VI in FIG. 7.
Figure 7:
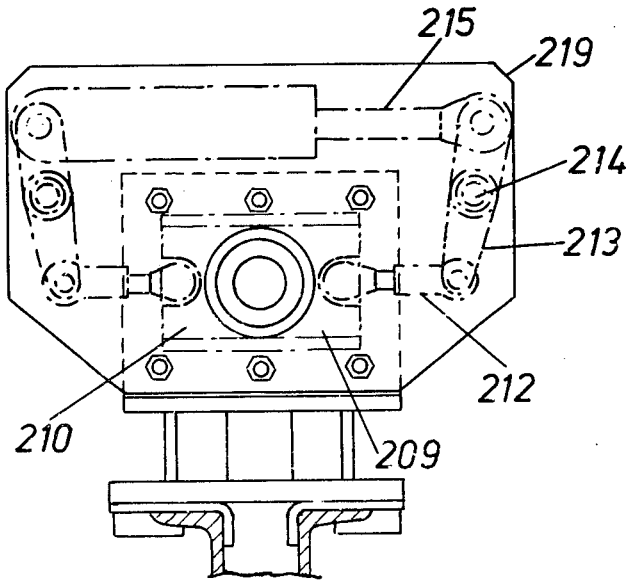
FIG. 7 shows a top view of said second embodiment.

In FIGS. 6 and 7 an alternative embodiment of a drill rod centralizer is shown. The main difference between this embodiment and the one shown in FIGS. 2 and 3 is that the tube 201 is formed with a shortened length and a width suited for use in connection with several drill bits having different diameters. This means that this drill rod centralizer is not meant for guiding the bit during the collaring. The members which correspond to the ones shown in FIGS. 2 and 3 are given the same reference numerals. The tube 201 is attached to the prism shaped member 202 via an intermediate member 229. Inside the tube 201, there are mounted two plates, 227 and 228. The seal ring 222 is mounted in the plate 227. The plate 228 is provided with a portion 231 having an inner diameter which is the same as that of the sleeve 218. The tubular member 201 is attached to the lower portion of the saddle 205 by means of a fastening means 226.

The arrangement according to the invention operates as follows. The rock drilling machine 15 is moved along the feed bar 14 to a position rearwardly of the drill rods 25 in the magazine. The transferring arm 26 is swung by the motor 59 towards the magazine, where the spinning device 27 grips a rod. The spinning device comprises three rollers, which are mutually opposed and adapted to rest against a rod during the gripping thereof. One of the rollers is reversibly driven. The others are movable toward and away from one another. The axis of the rollers are inclined with respect to the drill axis, by means of which the rod will be moved axially during the rotation thereof by means of the driven roller. The transferring arm takes the rod to the drill axis. A drill bit exchanging device 21, a drill bit being placed therein, is swung to the drill axis. By rotating the inclined rollers, the rod 25 is screwed into the drill bit which is non-rotatably held by the bit exchanging device. During these operations, the drill rod centralizer 20 is in a position rearwardly of the bit exchanging devices and is locked in this position by means of the hydraulically operated lugs 290, which are movable in a direction perpendicular to the longitudinal direction of the feed bar 14 and which are intended to co-operate with the saddle 205. When the drill bit has been screwed on, the rock drilling machine 15 is fed towards the rod 25 and its adapter is screwed into a coupling sleeve screwed on the rear end of the rod. The spinning device 27 is opened and the transferring arm 26 is swung towards the magazine and stays there, while gripping the rod coming next.

The rod 25 is drawn up by means of the rock drilling machine until the drill bit reaches the bit guide of the tube 201. The bit exchanging device 21 is now swung away from the drill axis. The jaws 209 and 210 in the drill rod centralizer 20 are brought together and the lugs 290 are moved out of engagement with the saddle 205. The drill rod centralizer is now carried by the drill bit by the resting of the latter against the lower end face of the sleeve 224. The rock drilling machine is fed ahead until the flange 225 of the drill rod centralizer rests against the ground. By the fact that the whole drill rod centralizer with the bit guiding tube slides down to abutment against the ground, an effective guiding of the bit during the collaring is achieved, by means of which the hole really gets the direction to which the feed bar has been adjusted. This makes it possible to carry out the collaring with full efficiency independently of the nature of the ground. During collaring, where the rock surface is covered by a loose overburden, a crater forms easily around the hole. In this case, the bit guiding tube follows to the bottom of the crater and there guides the drill bit. If a great accuracy regarding direction and straightness of the hole is required, the drill bit can be designed with an extended guiding length. The tube 223 of the drill rod centralizer is connected to a drill dust suction system (not shown). By the good ground contact and by the good accordance with the hole diameter of the drill bit guiding tube there is also achieved an effective removal of drill dust. During the drilling, the jaws 209 and 210 will on the one hand guide the drill rod and on the other seal against the rearward blowing-out of the drill dust. The ring 222 contributes to a still improved sealing for preventing the blowing-out of the drill dust.

When the drill rod has been drilled down so far that the coupling sleeve 221 screwed on the rear end thereof has reached the sleeve 218, the drilling is broken off. The rock drilling machine is rotated in a reverse direction, whereby the adapter is screwed out off the coupling sleeve. The sleeve brake, not shown, placed on the saddle of the rock drilling machine is automatically swung towards and against the sleeve 221 by means of a reverse rotation of the rock drilling machine. During the unscrewing of the adapter, the sleeve, thus, will remain on the end of the drill rod. After the unscrewing of the adapter, the rock drilling machine is moved backwards along the feed bar to a position above the magazine member 24. After that, the transferring arm 26 takes a new drill rod to the drill axis. When in alignment with the drill axis, the drill rod is screwed into the coupling sleeve on the rod next ahead by actuating the motors of the spinning device 27. The string being in the drill hole is guided during the coupling by the jaws 209, 210. The adapter of the rock drilling machine is screwed into the coupling sleeve of the new drill rod and the transferring arm 26 is swung to the magazine where the spinning device 27 grips the rod coming next. During the time in which the sleeve passes the jaws 209, 210 while being moved downwards, the jaws have to be opened. Sealing and guiding are then instead secured against the outer diameter of the sleeve by virtue of the fact that the fixed passages 224 and 218 respectively which are mounted respectively below and above the jaws have substantially the same diameter as the sleeve. The suction efficiency obtained by the drill dust suction system is enough to seal the annular gap between the guide surfaces 218, 224 and the coupling sleeves 221. When the guide jaws are brought together, the gap-sealing is maintained between these jaws and the drill rods. The distance between the sleeve 218 and the sleeve 224 is such that the forward portion of the coupling sleeve 221 reaches the sleeve 224 before the rear portion thereof leaves the sleeve 218. The drilling continues until the desired hole depth is reached or until the drill bit because of wear has to be exchanged to a new one.

Before the drill string is drawn up out of the hole, the threads incorporated in the string are shaken to come loose by the impactor of the rock drilling machine, while the bit is resting against the bottom of the hole. The drill rod centralizer 20 is drawn up along the feed bar by the resting of the coupling sleeve 221 against the underside of the jaws 209, 210 during the withdrawal of the string. The drill rod centralizer is kept in a drawn-up position by means of the hydraulically operated lugs 290. The jaws 209, 210 are adapted to grasp around and under the coupling sleeves 221 in order to hold the string in the hole during the withdrawal. The transferring arm 26 is swung to the drill axis where the spinning device 27 grips the rod, after which the adapter of the rock drilling machine is screwed out of the coupling sleeve of the uppermost drill rod, whereas the sleeve brake safeguards that the sleeve remains on the rod. The rod is then screwed out of the sleeve in the drill rod centralizer 20 by means of the spinning device 27 and is transferred to the magazine. The axially affixed position of the drill rod centralizer is chosen with respect to the bottom of the magazine so that the rod being unscrewed is at right height. The rock drilling machine, then, is moved down and draws up the string another rod length, after which the next rod is unscrewed and is transferred to the magazine. The withdrawal of drill rods continues in the same manner until only the last rod remains. This rod is drawn up by the rock drilling machine until the drill bit reaches the bit guiding tube 201. If the drill bit has to be exchanged, an empty bit exchanging device 21 is swung into the drill axis. The drill bit is brought down into the bit exchanging device and is unscrewed.

If a joint in the string has not gotten loose, this one has to be broken manually. This system is economically the most advantageous provided that it is not frequently that manual breaking of drill string joints has to be resorted to. If necessary, however, the saddle, of the drill rod centralizer can be provided with a couple of nonrotating jaws with a greater clamping capacity than the ones shown and which griping about the round drill rod below the coupling sleeve, and with a swingable and turnable pipe wrench which grips about the round rod above the sleeve.

The invention is not limited to the above discussed embodiments shown in the drawings by way of example. Thus, the invention may be applied in any system of handling drill rods having a magazine or not. The drill bits may be screwed on and unscrewed manually.

What we claim is:

1. In a method of rock drilling by means of a string (18) of connected drill rods, said string being formed with an increased diameter at the portions where two adjacent rods are connected, comprising moving the string through a drill rod centralizer (20) while removing drill dust therefrom by suction, the improvement comprising guiding and gap-sealing of the drill string constantly during the drilling by providing first guide surface means for (216) for guiding and gap-sealing of the drill rods, and providing second and third guide surface means (218, 224; 218, 231) at respective opposite sides of said first guide surface means in the longitudinal direction of the drill rods for guiding and gap-sealing of the connection portions of adjacent drill rods; selectively moving said first guide surface means out of guiding and gap-sealing engagement with a drill rod to permit passage of a connection portion thereby, said second and third guide surface means providing guiding and gap-sealing when said first guide surface means is so moved; said first, second and third guide surface means being all located in the drill rod centralizer (20) rearwardly of the place (223) of suction so that said suction effectively seals respective clearance gaps between said first guide surface means and a drill rod and between said second and third guide surface means and a connection portion.

2. A method according to claim 1, comprising maintaining the guide and gap-sealing of the drill rods by means of radially movable guide jaws (209,210) located in the drill rod centralizer when said jaws are in a position moved towards each other to define a guide surface, said jaws comprising said first guide surface means.

3. A method according to claim 2, comprising maintaining the guiding and gap-sealing of the connection portions of adjacent drill rods by means of second and third guide surfaces (218, 224; 218, 231) located respectively at both sides of said guide jaws when said jaws are in a position moved apart from one another, said second and third guide surfaces comprising said second and third guide surface means.

4. An apparatus for guiding and sealing a string (18) of connected drill rods during drilling, comprising an elongated support (14) for a rock drill movable therealong, a string (18) of connected drill rods, said string being connectable at one end thereof to said rock drill to be driven longitudinally with respect to said support, said string having an increased diameter at the portions (221) where two adjacent rods are connected, a drill rod centralizer (20) mounted on said support, dust removing means connected to said drill rod centralizer for removing drill dust therefrom by suction, at least two guide jaws (209, 210) in said drill rod centralizer located rearwardly of said dust removing means and arranged movably towards and away from each other, said guide jaws providing a substantially cylindrical inner surface for guiding and sealing a drill rod when in a position moved towards each other, a first substantially cylindrical inner surface (218) in said drill rod centralizer located rearwardly of said guide jaws, and a second substantially cylindrical inner surface (224; 231) located between said guide jaws and said dust removing means, said first and second substantially cylindrical inner surfaces providing the guiding and sealing of said connection portions of the string.

5. An apparatus according to claim 4, wherein the distance between said first and second cylindrical inner surfaces is less than the axial extent of said increased diameter portions.

6. In a drill rig, in combination: an elongated support (14), a rock drill (15) mounted on said support for longitudinal movement therealong, a string (18) of connected drill rods, said string being connectable at one end thereof to said rock drill to be driven longitudinally with respect to said support, a drill bit (19) mounted on the other end of said string, a drill rod centralizer (20) mounted axially displaceably on said support, said drill rod centralizer having a front portion (201), and means for fixedly holding said support with respect to the ground during drilling, the improvement comprising guiding means for said drill bit in said front portion (201) of said drill rod centralizer, said guiding means having a substantial axial extent, and said drill rod centralizer having an axial extent forwardly of said support for resting against the ground when in a projected position relative to said support.

7. Apparatus according to claim 6, wherein said front portion (201) of said drill rod centralizer is tubular and has an inner diameter which is substantially equal to the outer diameter of said drill bit.

8. Apparatus according to claim 6, comprising a saddle (205) which is slidable along said support, and wherein said drill rod centralizer is mounted on said saddle.

9. In a drill rig, in combination: an elongated support (14), a rock drill (15) mounted on said support for longitudinal movement therealong, a string (18) of connected drill rods, said string being connectable at one end thereof to said rock drill to be driven longitudinally with respect to said support, a drill bit (19) mounted on the other end of said string, a drill rod centralizer (20) mounted displaceably axially on said support, guide jaws (209, 210) in said drill rod centralizer, said guide jaws being movable radially towards and away from each other, means (290) for locking said drill rod centralizer against forward displacement when being in a rear position relative to said support, said drill string having an increased diameter at the portions (221) where two adjacent drill rods are connected, said guide jaws being arranged to carry said drill string by gripping the string at said increased diameter portions during disconnection of the rearmost drill rod when said drill rod centralizer is in said rear position, a magazine (22, 23, 24) for storing said drill rods, said magazine having a bottom member for supporting said drill rods, and said rear position of the drill rod centralizer being arranged relative to the axial position of said bottom member so that the axial position of the end of a drill rod being disconnected substantially coincides with the axial position of said bottom member.

10. Apparatus according to claim 9, wherein said drill rod centralizer is displaced along said support by means of said drill string during the withdrawal out of and the moving down into the drill hole of said drill string.

* * * * *